US007804390B2

(12) United States Patent
Kosugi et al.

(10) Patent No.: US 7,804,390 B2
(45) Date of Patent: Sep. 28, 2010

(54) TRANSFORMER FOR POWER SUPPLY

(75) Inventors: Akifumi Kosugi, Takasaki (JP); Kichi Kikuchi, Takasaki (JP); Yasuo Hosaka, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 42 days.

(21) Appl. No.: 12/257,346

(22) Filed: Oct. 23, 2008

(65) Prior Publication Data

US 2009/0108979 A1 Apr. 30, 2009

(30) Foreign Application Priority Data

Oct. 25, 2007 (JP) ..... 2007-278225

(51) Int. Cl.
*H01F 27/30* (2006.01)
*H01F 27/24* (2006.01)

(52) U.S. Cl. ..... 336/208; 336/198; 336/212

(58) Field of Classification Search ..... 336/90, 336/198, 212, 208
See application file for complete search history.

(56) References Cited

U.S. PATENT DOCUMENTS 4,931,761 A * 6/1990 Kijima ..... 336/160
6,894,596 B2 * 5/2005 Suzuki ..... 336/83
6,967,558 B2 * 11/2005 Fushimi ..... 336/208

FOREIGN PATENT DOCUMENTS

JP 09-186024 A1 7/1997
JP 10241977 A * 9/1998
JP 11-233348 A1 8/1999

* cited by examiner

*Primary Examiner*—Elvin G Enad
*Assistant Examiner*—Tszfung Chan
(74) *Attorney, Agent, or Firm*—Law Office of Katsuhiro Arai

(57) ABSTRACT

A transformer for use in a power supply has a primary winding, a secondary winding, a bobbin on which the primary and secondary windings are separately wound, and a core subassembly mounted in the bobbin. An opening is formed in the cylindrical portion of the bobbin, and an inside core in the magnetic core insertion hole and an outside core located outside the hole are adhesively bonded together via a spacer through the opening in the cylindrical portion.

9 Claims, 9 Drawing Sheets

[Fig. 1]
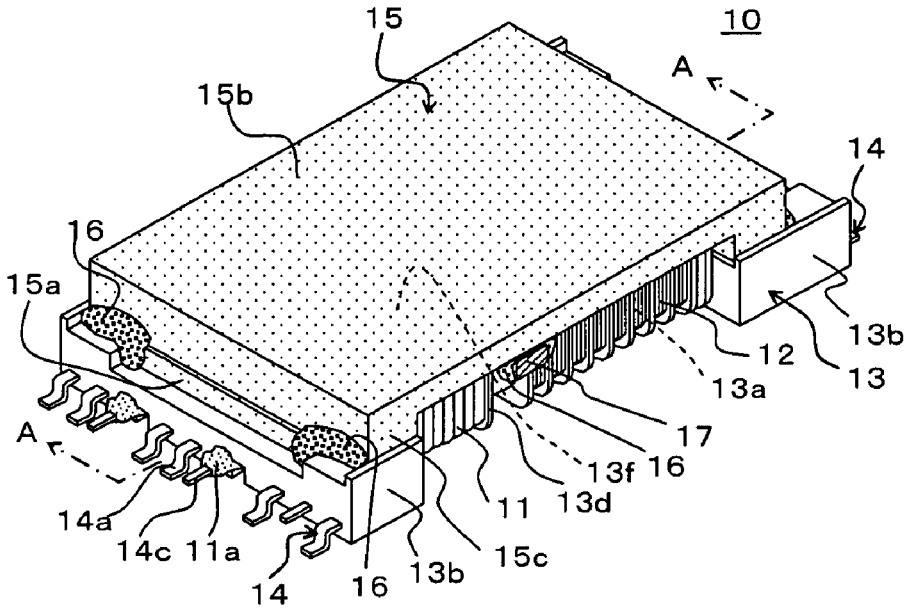
[Fig. 2]
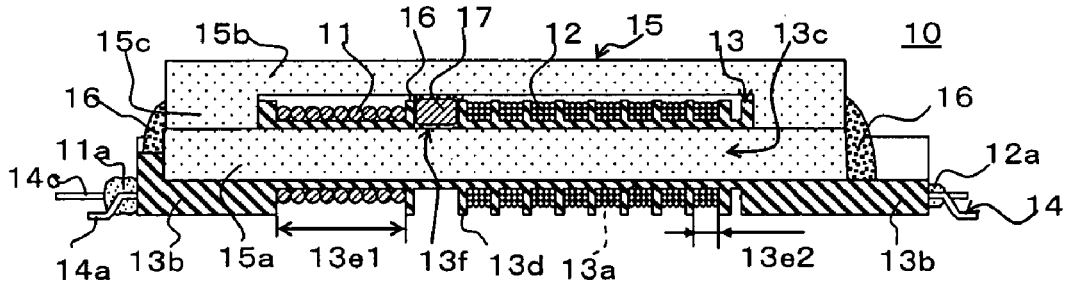

[Fig. 3]
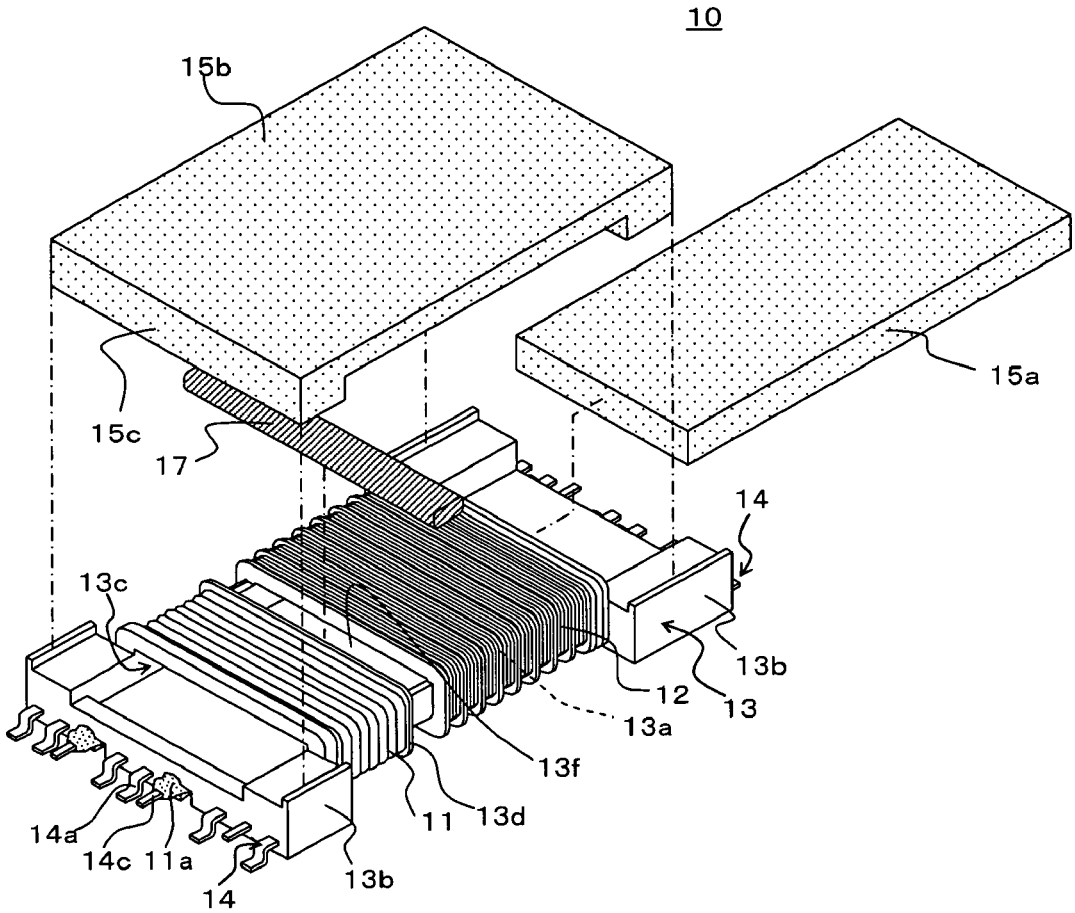

[Fig. 4]
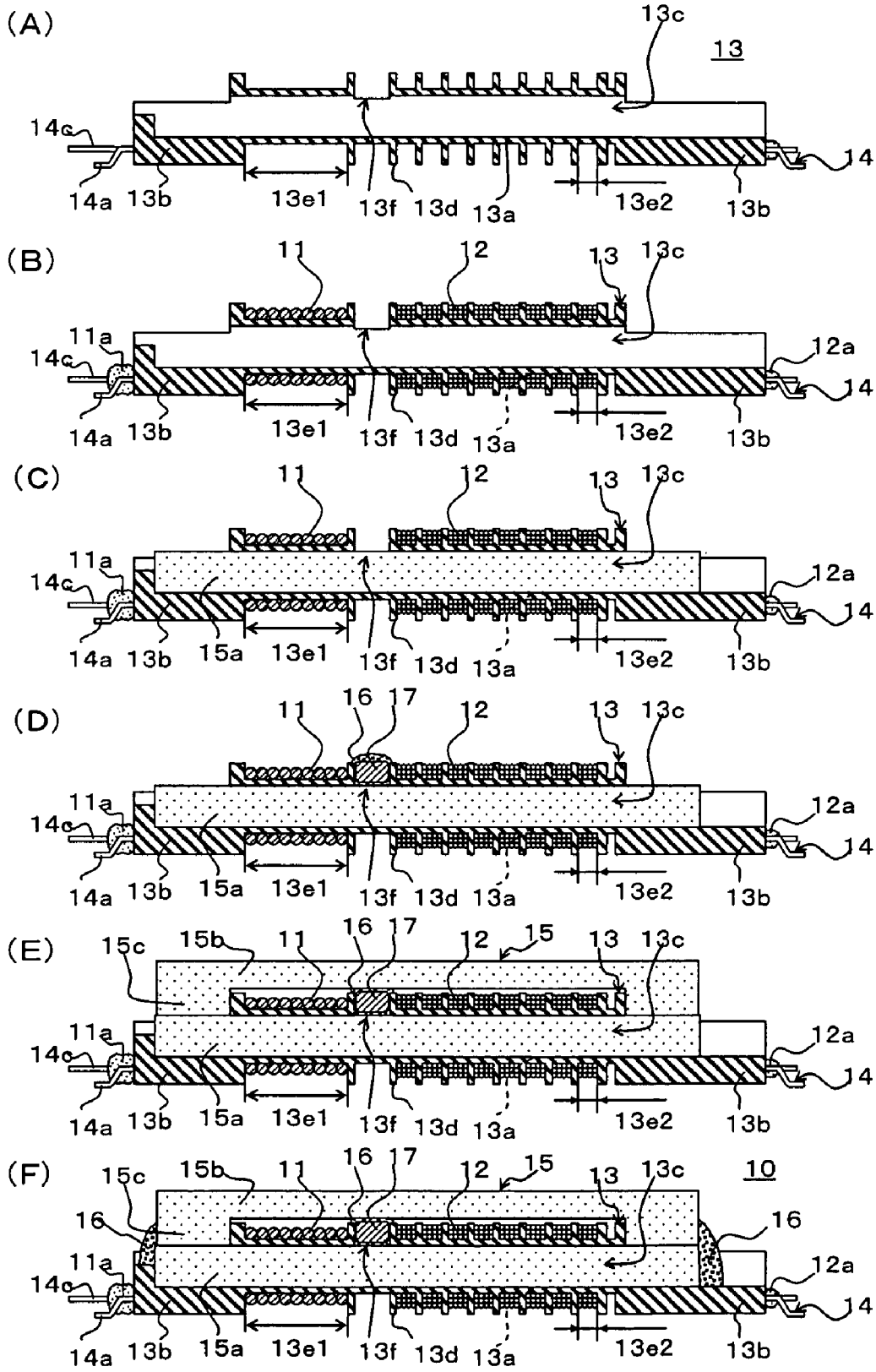

[Fig. 5]
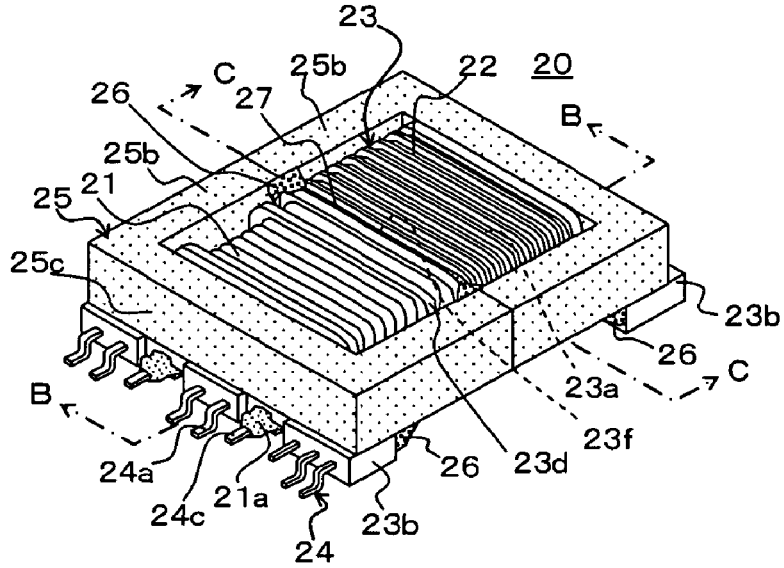
[Fig. 6]
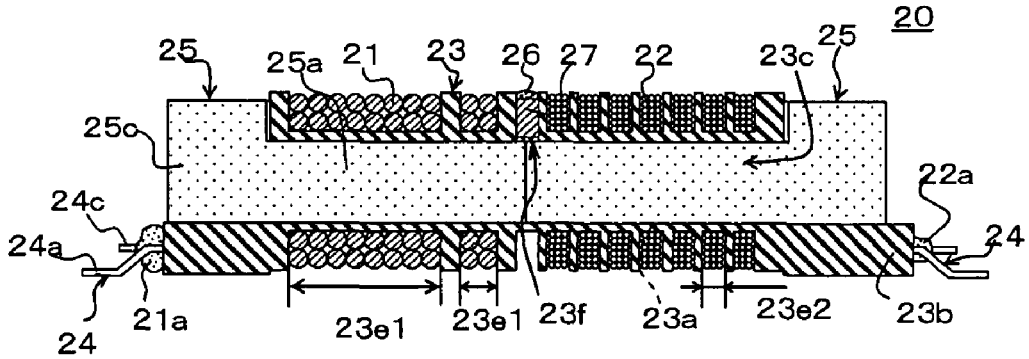
[Fig. 7]
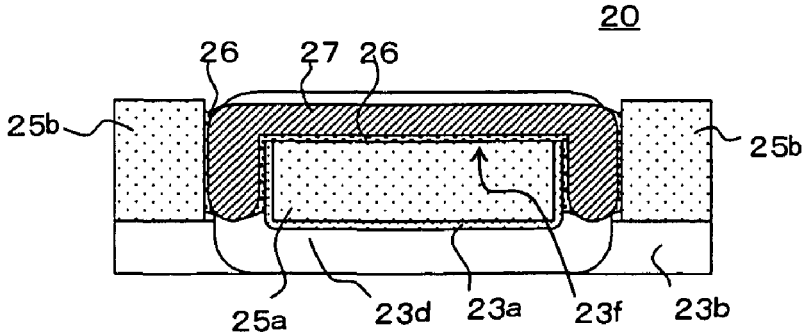

[Fig. 8]
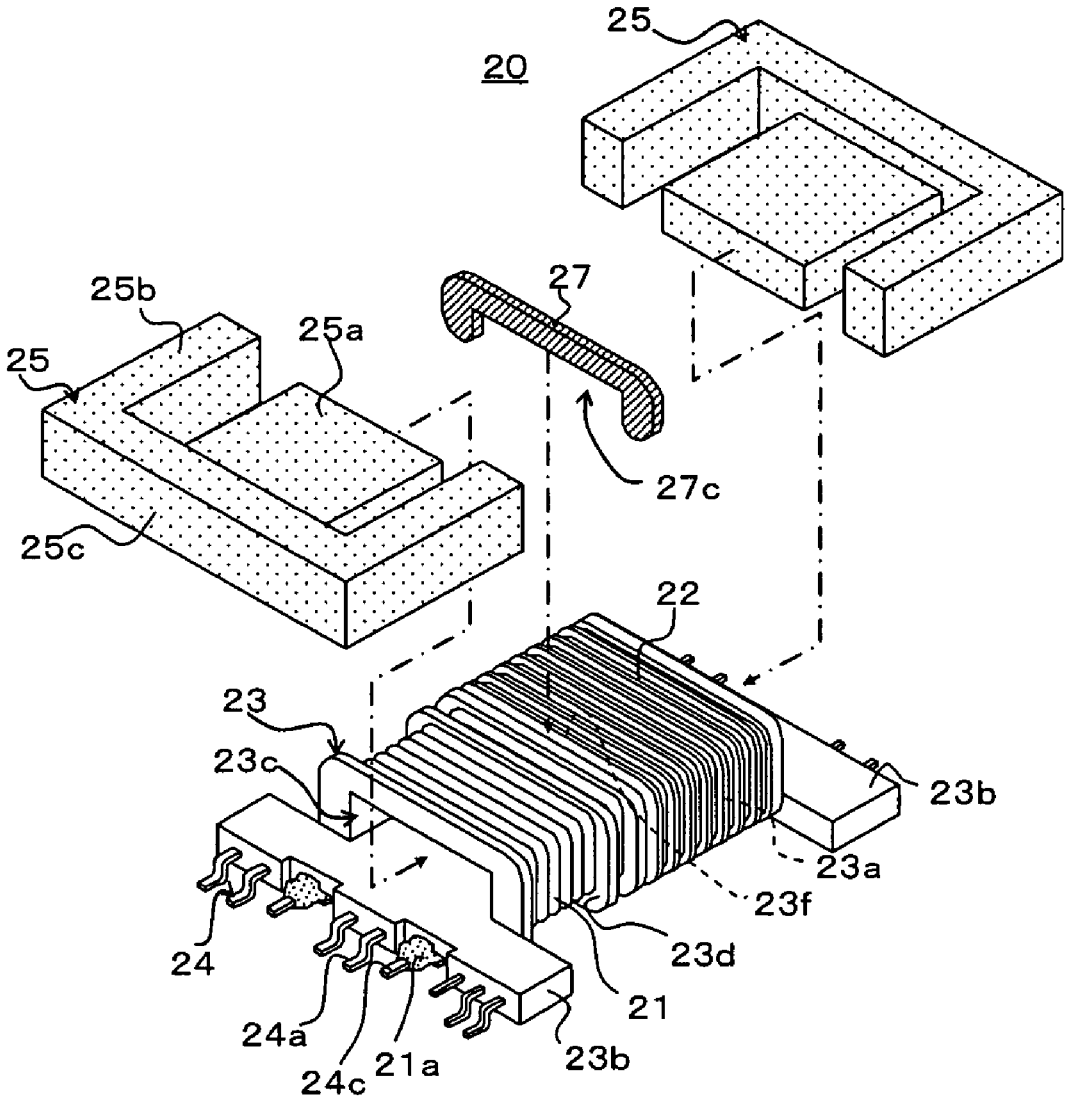

[Fig. 9]
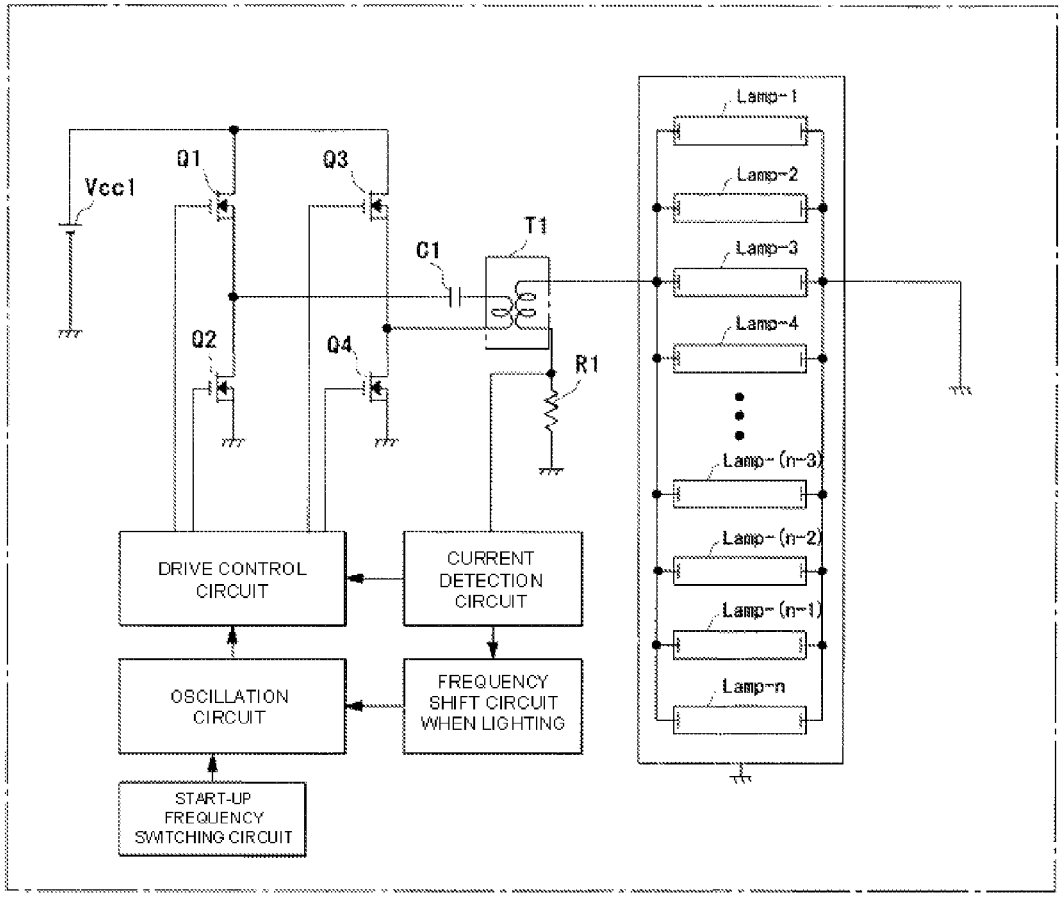

[Fig. 10]
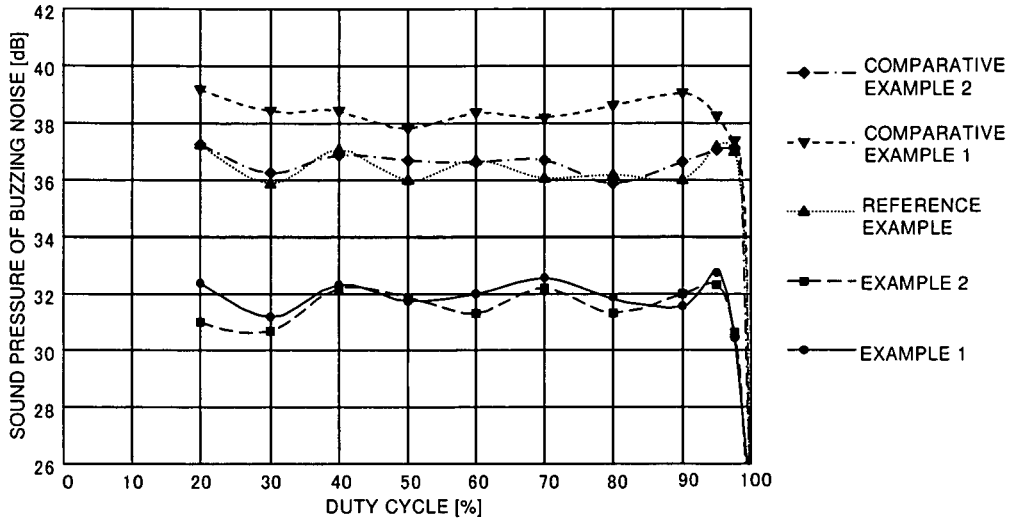
[Fig. 11]
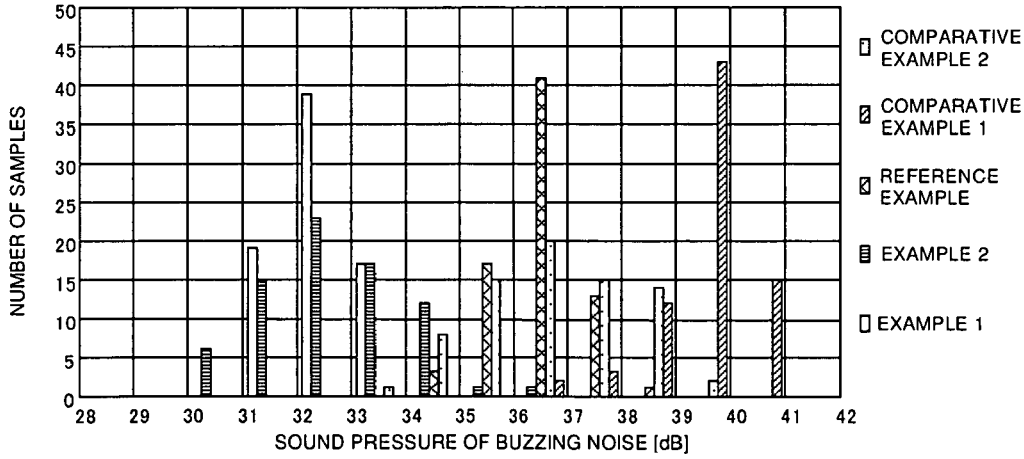

[Fig. 12] Background Art
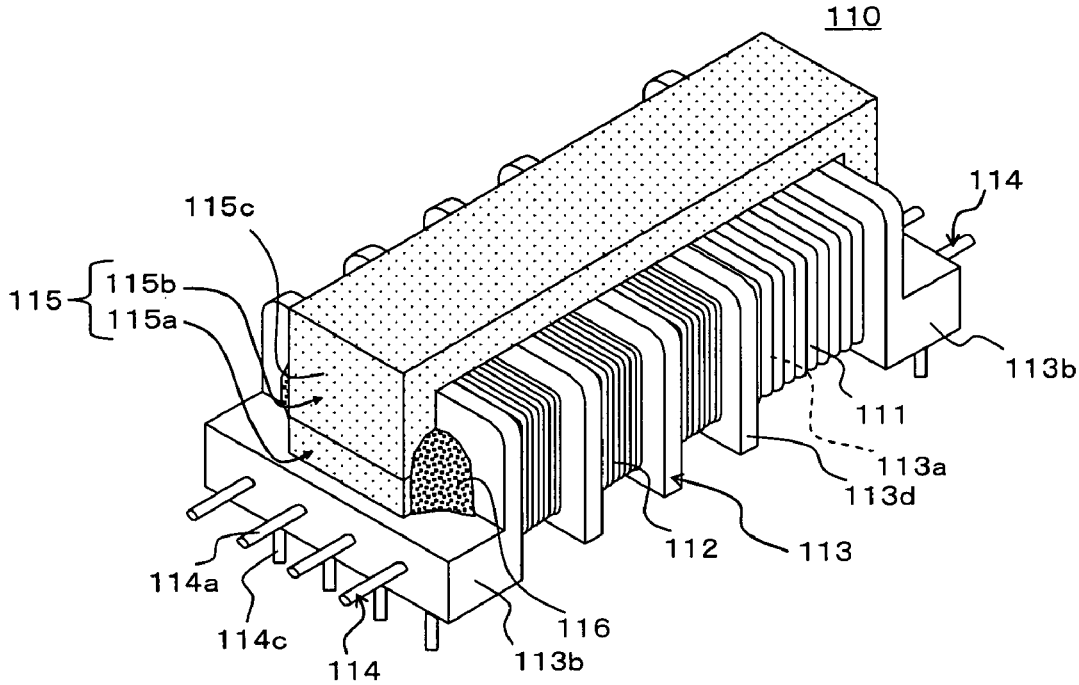
[Fig. 13] Background Art
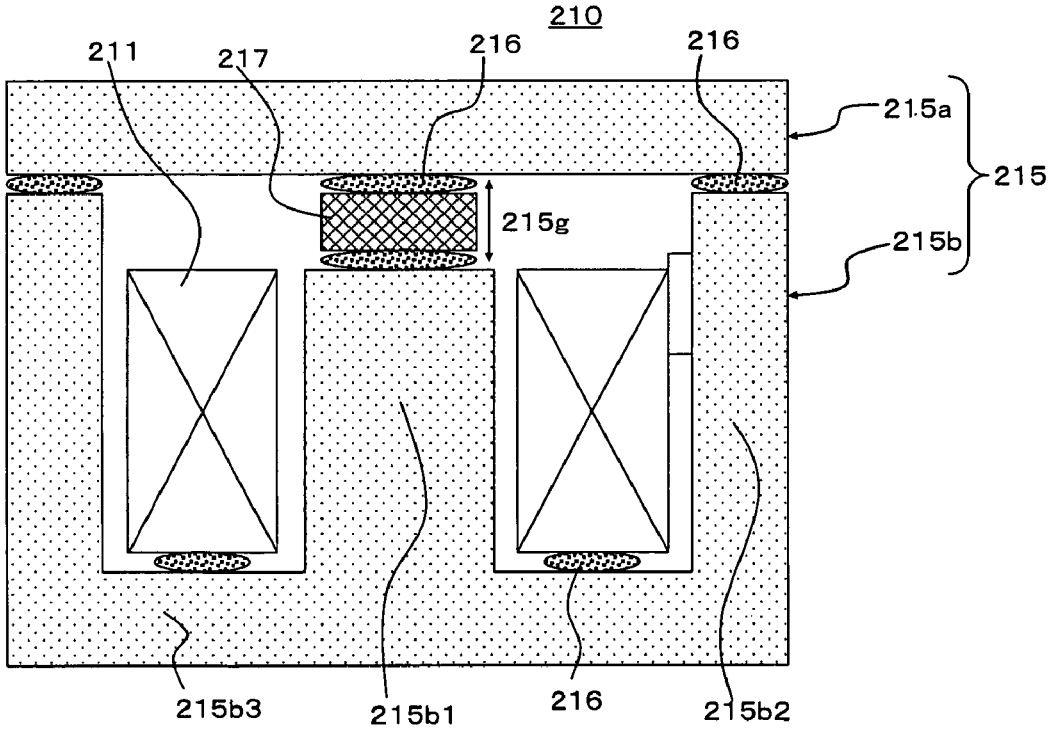

[Fig. 14]
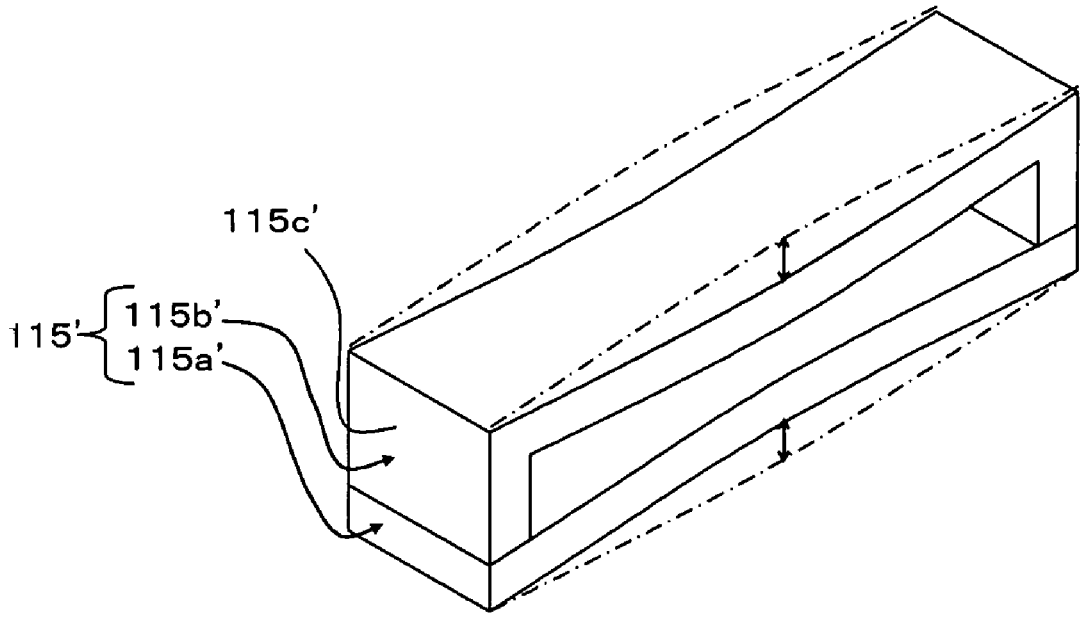

TRANSFORMER FOR POWER SUPPLY

BACKGROUND OF THE INVENTION

1. Field of the Invention

The present invention relates to a transformer for use in a power supply and, more particularly, to a transformer which is for use in a power supply and which drives the backlight of a display panel of an electronic instrument, such as a liquid crystal TV or car navigational system, through an inverter.

2. Description of the Related Art

An electronic instrument such as a liquid crystal TV or car navigational system is equipped with a backlight using cold cathode fluorescent lamps or other electric-discharge lamps. To light up these electric-discharge lamps, inverter circuits have been used for obtaining high voltages from low-voltage DC power supplies.

Referring to FIG. 12, a transformer 110 using a magnetic core 115 has been proposed as a transformer for a power supply used to drive an inverter circuit in patent reference 1. The magnetic core 115 is made of ferrite cores. In the transformer 110, the magnetic core 115 is made of a combination of an I-shaped core 115*a* and a U-shaped core 115*b*. A primary winding 111 and a secondary winding 112 are wound around a bobbin 113 having a cylindrical portion 113*a* provided with a magnetic core insertion hole (not shown). The I-shaped core 115*a* is mounted in the magnetic core insertion hole. The U-shaped core 115*b* is located over the bobbin 113 as viewed in a direction orthogonal to the direction in which the windings are wound on the bobbin 113. The U-shaped core 115*b* is opposite to the I-shaped core 115*a* along a line located outside the magnetic core insertion hole in the bobbin 113.

However, in the aforementioned transformer 110 for the backlight, where the used switching pulses have a frequency lying in the audio frequency band, the whole transformer buzzes due to resonance phenomena of higher harmonics.

Patent reference 2 proposes a technique for reducing buzzing. In particular, as shown in FIG. 13, an EI-shaped magnetic core 215 has an E-shaped magnetic core 215*b* including a center pole of magnetic core 215*b*1. The center pole of magnetic core 215*b*1 is located opposite to an I-shaped magnetic core 215*a*. A magnetic gap 215*g* is formed between the center pole of magnetic core 215*b*1 and I-shaped magnetic core 215*a*. A spacer 217 whose both surfaces have been applied with adhesive 216 is mounted in the magnetic gap 215*g*. Thus, a coil component 210 is suppressed from buzzing.

Patent reference 1: JP-A-9-186024

Patent reference 2: JP-A-11-233348

As described above in relation to the related art, in the transformer 110 for a power supply, at least one of the cores 115*a* and 115*b* is inserted in the magnetic core insertion hole formed in the cylindrical portion 113*a* of the bobbin 113. If the cores 115*a* and 115*b* of the core subassembly are adhesively bonded respectively to the bases 113*b* of the bobbin 113 to prevent the core subassembly 115 from coming off, there is the problem that the level of sound pressure produced by the aforementioned buzzing is increased. In addition, the level of sound pressure produced by the buzzing varies widely from product to product. Confirmation of the level of sound pressure produced by each individual product has presented problems.

In the technique of patent reference 2, if the spacer 217 whose both surfaces have been applied with adhesive 216 is interposed in the magnetic gap 215*g* between the center pole of magnetic core 215*b*1 of the E-shaped magnetic core 215*b* and the I-shaped magnetic core 215*a* of the EI-shaped magnetic core 215 as described above in relation to the related art, the level of sound pressure produced by the buzzing tends to decrease but the level of sound pressure varies more widely among products. Consequently, confirmation of the level of sound pressure produced by each individual product has presented problems.

In the technique of patent reference 1, if the spacer whose surfaces opposite to the cores have been applied with adhesive is interposed between the cores in the backlight transformer 110 as described above in relation to the related art, it has been impossible to obtain the expected buzzing-suppressing effects. There is another problem that the magnetic coupling between the primary winding 111 and secondary winding 112 decreases.

SUMMARY OF THE INVENTION

The present inventors have noticed that in a transformer for power supply where at least one of the cores of the magnetic core is inserted in the magnetic core insertion hole formed in the cylindrical portion of the bobbin and the cores are adhesively bonded respectively to the bases of the bobbin, the I-shaped core 115*a*' in the magnetic core insertion hole and the U-shaped core 115*b*' located outside the magnetic core insertion hole vibrate greatly in the up-and-down direction around the longitudinal center of the magnetic core insertion hole in the bobbin as shown in FIG. 14. After the results of the inventors' earnest researches, it was found that the vibrations can be suppressed by adhesively bonding together the core located in the magnetic core insertion hole and the core located outside the magnetic core insertion hole through an opening formed in the cylindrical portion of the bobbin. Thus, the present invention has been completed.

It is an object of an embodiment of the present invention to provide a transformer which is for use in a power supply and which uses switching pulses having a frequency lying in the audio frequency band, the transformer being characterized in that the level of sound pressure created by buzzing noise is reduced. It is another object of an embodiment of the invention to provide a transformer which is for use in a power supply and which can be manufactured stably in such a way that buzzing noises produced by individual products are less different in level of sound pressure.

At least one of the above-described objects is achieved in accordance with the teachings of at least one embodiment of the present invention by a transformer for use in a power supply, the transformer having: (1) a primary winding, a secondary winding, a bobbin on which the primary and secondary windings are separately wound, and a core subassembly including cores. The core subassembly is mounted in the bobbin and forms a closed magnetic loop magnetically coupling together the primary and secondary windings. The bobbin has a cylindrical portion and plural bases mounted at least on both ends of the cylindrical portion. The cylindrical portion is provided with a magnetic core insertion hole. The cylindrical portion is hollow and can have any cross sectional shape such as a rectangle, oval, other polygons, circle, and the cylindrical portion may also be referred to as "a trunk portion." The cylindrical portion has a wire winding area that is partitioned into plural regions by middle guard. Plural terminals are mounted on the bases, respectively. The primary winding is wound around some region of the cylindrical portion. Ends of the primary winding are connected with different connected terminals of at least one of the bases. The secondary winding is wound around the other region of the cylindrical portion. Ends of the secondary winding are connected with different connected terminals of the other base.

At least one core of the core subassembly is inserted in the magnetic core insertion hole. At least some portions of the core subassembly are adhesively bonded to the bases, respectively.

The cylindrical portion of the bobbin is provided with an opening between the regions on which the windings are wound to expose a part of the core inserted in the magnetic core insertion hole. The core located inside the magnetic core insertion hole and the core located outside the magnetic core insertion hole are adhesively bonded together through the opening in the cylindrical portion. In this structure, the adhesive bonding causes distortional vibrations due to magnetic distortions of the core in the magnetic core insertion hole and the core located outside the magnetic core insertion hole around the longitudinal center of the magnetic core insertion hole formed in the bobbin to be suppressed by each other. Consequently, the level of sound pressure due to buzzing noise can be reduced greatly.

One main aspect of the above-described transformer for a power supply has the features (1) described above. In addition, it is characterized in that (2) the cores are made of an I-shaped core and a U-shaped core. Consequently, a transformer for power supply which has a simple structure and which generates buzzing noise of reduced sound pressure level can be offered.

Another main aspect of the above-described transformer for a power supply has the features (1) described above. In addition, it has (3) a spacer inserted between the core located in the magnetic core insertion hole and the core located outside the magnetic core insertion hole. The core in the magnetic core insertion hole and the core located outside the magnetic core insertion hole are adhesively bonded to each other via the spacer. Consequently, if the state of application of the adhesive is slightly nonuniform, the space between the core located inside the magnetic core insertion hole and the core located outside the magnetic core insertion hole is held constant.

A further aspect of the transformer of the present invention for a power supply has the feature (3) described above. In addition, it is characterized in that (4) the spacer is made of a nonmagnetic material. In consequence, variations in sound pressure of buzzing noise can be reduced without reducing the magnetic coupling between the primary and secondary windings.

An additional aspect of the transformer of the present invention for a power supply has the feature (3) described above. In addition, it is characterized in that (5) the spacer is placed in position by the middle guard of the cylindrical portion. Consequently, it is easy to assemble the transformer. The sound pressure level of buzzing noise can be reduced. In addition, variations in sound pressure among products can be reduced.

An additional aspect of the transformer of the present invention for a power supply has the feature (3) described above. In addition, it is characterized in that (6) the spacer is provided with a notch into which the cylindrical portion fits. Consequently, it is easy to assemble the transformer. The sound pressure level of buzzing noise can be reduced. In addition, variations in sound pressure among products can be reduced.

An additional aspect of the transformer of the present invention for a power supply has the feature (3) described above. In addition, it is characterized in that (7) the spacer is higher in hardness than the adhesive. In consequence, the resonance point of vibrations of the core subassembly shifts toward higher frequency side. As a result, the sound pressure level of buzzing noise can be reduced. In addition, variations in sound pressure among products can be reduced.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are oversimplified for illustrative purposes and are not to scale.

FIG. 1 is a perspective view showing the appearance (i.e., the whole structure) of a transformer according to a first embodiment of the present invention, the transformer being for use in a power supply;

FIG. 2 is a vertical cross section taken on line A-A of FIG. 1, showing the internal structure of the transformer for power supply according to the first embodiment;

FIG. 3 is an exploded perspective view illustrating the internal structure of the transformer for power supply according to the first embodiment;

FIGS. 4A-4F are vertical cross sections showing one example of procedure of assembling the transformer for power supply according to the first embodiment;

FIG. 5 is a perspective view showing the appearance (i.e., the whole structure) of a transformer according to a second embodiment of the invention, the transformer being for use in a power supply;

FIG. 6 is a vertical cross section taken on line B-B of FIG. 5, showing the internal structure of the transformer for power supply according to the second embodiment;

FIG. 7 is a vertical cross section taken on line C-C of FIG. 5, showing the internal structure of the transformer for power supply according to the second embodiment;

FIG. 8 is an exploded perspective view showing the internal structure of the transformer for power supply according to the second embodiment;

FIG. 9 is a circuit diagram of an electric-discharge lamp-lighting device used for measurement of sound pressure levels produced from transformer for power supply for use in a power supply, the transformer for power supply being built according to embodiments of the present invention;

FIG. 10 is a graph showing the results of measurements of sound pressure levels produced from transformer for power supply according to embodiments of the present invention;

FIG. 11 is a graph showing the results of measurements of variations in sound pressure level among individual products of transformer for power supply according to embodiments of the present invention;

FIG. 12 is a perspective view of one conventional transformer, showing the outer appearance;

FIG. 13 is a vertical cross section of another conventional transformer; and FIG. 14 is a schematic perspective view of the cores of the conventional transformer shown in FIG. 12, illustrating one example of magnetostriction vibrations.

DETAILED DESCRIPTION OF THE INVENTION

The present invention will be explained in detail with reference to preferred embodiments and drawings. However, the preferred embodiments and drawings are not intended to limit the present invention.

A transformer according to a first embodiment of the present invention is described below by referring to FIGS. 1-4, the transformer being for use in a power supply. FIG. 1 is a perspective view showing the appearance (i.e., the whole structure) of the transformer, indicated by numeral 10, according to the first embodiment of the invention. FIG. 2 is a vertical cross section taken on line A-A of FIG. 1, showing the internal structure of the transformer for power supply 10 of the present embodiment. FIG. 3 is an exploded perspective view, illustrating the internal structure of the transformer 10 of the present embodiment. FIG. 4 is a vertical cross section showing one example of procedure of assembling the transformer for power supply 10 of the present embodiment.

As shown in FIGS. 1-3, the transformer for power supply 10 according to the present embodiment has a primary winding 11, a secondary winding 12, a bobbin 13 having separate regions on which the primary winding 11 and secondary winding 12 are respectively wound, and a core subassembly 15 mounted in the bobbin 13. The core subassembly 15 includes an I-shaped core 15*a* and a U-shaped core 15*b* and forms a closed magnetic loop to magnetically couple the primary winding 11 and secondary winding 12.

In particular, the bobbin 13 has a cylindrical portion 13*a* and plural bases 13*b* mounted at least at the opposite ends of the cylindrical portion 13*a*. The cylindrical portion 13*a* is provided with a magnetic core insertion hole 13*c*, and has a wire winding area. The wire winding area is partitioned into plural regions by a middle guard 13*d*. Plural terminals are attached to each of the bases 13*b*.

The primary winding 11 is wound on some region of the cylindrical portion 13*a*. The ends 11*a* of the winding 11 are connected with different connected terminals 14 of at least one base 13*b* of the plural bases of the bobbin 13.

The secondary winding 12 is wound on the other region of the cylindrical portion 13*a*. The ends 12*a* of the winding 12 are connected with different connected terminals 14 of the other base 13*b* of the bobbin 13.

At least one core of the core subassembly 15 is inserted in the magnetic core insertion hole 13*c*. At least some portions of the core subassembly are bonded to the bases 13*b* with adhesive 16.

The cylindrical portion 13*a* of the bobbin 13 has an opening 13*f* on the upper side of the space between the plural regions on which the windings 11 and 12 are wound to expose a part of the I-shaped core 15*a* inserted in the magnetic core insertion hole 13*c*.

A spacer 17 is inserted between the I-shaped core 15*a* located inside the magnetic core insertion hole 13*c* and the U-shaped core 15*b* located outside the magnetic core insertion hole 13*c*. The I-shaped core 15*a* located inside the magnetic core insertion hole 13*c* and the U-shaped core 15*b* located outside the magnetic core insertion hole 13*c* are adhesively bonded to each other via the spacer 17 through the opening 13*f* in the cylindrical portion 13*a*.

The transformer for power supply 10 of the present embodiment is next described in further detail by referring to FIGS. 4A-4F.

As shown in FIG. 4A, the bobbin 13 has the cylindrical portion 13*a*, as well as the bases 13*b* mounted on the opposite ends of the cylindrical portion 13*a*. The magnetic core insertion hole 13*c* is formed so as to extend through the center of the cylindrical portion 13*a*. On the surface of the cylindrical portion 13*a*, the region on which the primary winding 11 is wound and the region on which the secondary winding 12 is wound are partitioned from each other by the middle guard 13*d*. The region on which the secondary winding 12 is wound is further partitioned into subregions similarly by another middle guard 13*d*.

The opening 13*f* that is substantially rectangular as viewed within a plane is formed on the upper side of the space between the region of the cylindrical portion 13*a* of the bobbin 13 on which the primary winding 11 is wound and the region on which the secondary winding 12 is wound. The opening 13*f* is interposed between the two middle guard 13*d* and exposes, for example, a part of the I-shaped core 15*a* inserted in the magnetic core insertion hole 13*c*.

Plural connected terminals 14, each assuming an E-shaped or U-shaped form as viewed within a plane, for example, are mounted on each of the bases 13*b*. Each of the connected terminals 14 is made up of a terminal portion 14*a* on one end side, a connecting portion 14*c* on the other end side, and a buried portion (not shown) buried in the base 13*b*. The buried portion interconnects the terminal portion 14*a* and connecting portion 14*c*. Where each connected terminal 14 assumes an E-shaped form as viewed within a plane, two terminal portions 14*a* are connected, for example, to one connecting portion 14*c* by the buried portion (not shown). That is, the terminal portion 14*a* protrudes horizontally from the end surface of the base 13*b* and then is bent, so-called, like a gull wing from the bottom surface of the base 13*b* so as to protrude downward. The connecting portion 14*c* protrudes horizontally from the end surface of the base 13*b*. Where the connected terminal 14 assumes a U-shaped form as viewed within a plane, one terminal portion 14*a* is connected, for example, to one connecting terminal 14*c* by the buried portion (not shown). The U-shaped connecting terminal is similar to the E-shaped connecting terminal in other respects.

The primary winding 11 is made of so-called litz wire fabricated by twisting together plural magnet wires, for example. As shown in FIG. 4B, the primary winding is wound on the region of the cylindrical portion 13*a* of the bobbin 13 on which the primary winding 11 on one end side should be wound. Ends 11*a* of the primary winding 11 are pulled out to the front-end side of one base 13*b* via a pull-out groove (not shown) formed in a lower portion of the base 13*b* of the bobbin 13. The ends are bound to the connecting portion 14*c* of the connected terminal 14 mounted on the base 13*b* while an insulating coating is peeled off. The ends are immersed in molten solder to be electrically connected with the connected terminal 14.

The secondary winding 12 is made of an insulating coated lead having a diameter smaller than that of the primary winding 11. The secondary winding is wound on the regions of the cylindrical portion 13*a* of the bobbin 13 partitioned from each other to be wound by the secondary winding 12, from one end side toward the central guard on the bobbin 13 in turn. The ends 12*a* are pulled out toward the front end of the other base 13*b* via a pull-out groove (not shown) formed in a lower part of the base 13*b* of the bobbin 13. The ends 12*a* are bound to the connecting portion 14*c* of the connected terminal 14 mounted on the base 13*b* while the insulating coating is peeled off. The ends 12*a* are electrically connected with the connected terminal 14 by soldering or other method.

A demander for the transformer for power supply 10 of the present embodiment mounts the present transformer 10 on the circuit board of the power supply portion within the enclosure of an electronic instrument equipped with a liquid crystal display panel or the like, using an SMD (surface mounting device). The land electrodes on the circuit board are connected with the terminal portions 14*a* by a conductive joint material such as solder.

The cores of the core subassembly 15 are each made of a magnetic material such as Mn—Zn based ferrite. As shown in FIG. 4C, the I-shaped core 15*a* of the core subassembly 15 is inserted from one end side into the magnetic core insertion hole 13*c* in the bobbin 13 and brought into abutment with the convex portion of one base 13*b* of the bobbin 13 on one end side of the magnetic core insertion hole 13*c*. The I-shaped core is placed in position such that both ends of the I-shaped core 15*a* are made to protrude from the magnetic core insertion hole 13*c* and exposed on the base 13*b*.

A part of the upper side of the I-shaped core 15*a* inserted in the magnetic core insertion hole 13*c* is exposed from the opening 13*f* formed on the upper side in the space between the region of the cylindrical portion 13*a* of the bobbin 13 on which the primary winding 11 is wound and the regions on which the secondary winding 12 is wound.

Then, as shown in FIG. 4D, a rodlike spacer 17 is inserted and placed in position at a position located between the middle guard 13*d* on the opposite sides of the opening 13*f* and above the opening 13*f* while epoxy resin based adhesive 16 is applied on the outer surface of the spacer 17. For example, the spacer 17 is made of a liquid-crystal polymer that generally has features including high heatproofness, high rigidity, and low coefficient of thermal expansion.

As shown in FIG. 4E, the front ends of legs 15*c* of the U-shaped core 15*b* are moved from above the upper surface of the I-shaped core 15*a* and brought into abutment with the upper surface of the I-shaped core 15*a*. A part of the lower surface of the U-shaped core 15*b* is bonded to the I-shaped core 15*a* in the magnetic core insertion hole 13*c* with the adhesive 16 via the spacer 17.

Then, as shown in FIG. 4F, the ends of the cores 15*a* and 15*b* as viewed in the longitudinal direction of the magnetic core insertion hole 13*c* in the bobbin 13 are bonded to the bases 13*b*, for example, with the epoxy resin based adhesive 16.

The core subassembly 15 is held while the front ends of the legs 15*c* of the U-shaped core 15*b* are in abutment with one main surface of the I-shaped core 15*a* as described previously. Thus, the closed magnetic loop is formed, magnetically coupling the primary winding 11 and the secondary winding 12.

In the present embodiment, the transformer is a normal form of transformer for use in a power supply, i.e., one primary winding 11 and one secondary winding 12 are wound on the core subassembly 15. The present invention is not limited to this form. The transformer may also be a transformer of a so-called twin structure (not shown), i.e., two primary windings and two secondary windings are wound on one core subassembly forming a closed magnetic loop.

In particular, the first secondary winding, the first primary winding, the second primary winding, and the second secondary winding may be wound in this order, for example, from one end side on the plural regions on the surface of the cylindrical portion of the bobbin. An opening for exposing a part of the core inserted in the magnetic core insertion hole may be formed between the region of the surface of the cylindrical portion of the bobbin on which the first primary winding is wound and the region on which the second primary winding is wound. The core located in the magnetic core insertion hole and the core located outside the magnetic core insertion hole may be adhesively bonded together through the opening in the cylindrical portion.

As another example, the first secondary winding, the common primary winding, and the second secondary winding may be wound in this order from one end side on the plural regions of the surface of the cylindrical portion of the bobbin. An opening is formed in the cylindrical portion of the bobbin between the region on which the first secondary winding is wound and the region on which the common primary winding is wound. Another opening is formed in the cylindrical portion of the bobbin between the region on which the second secondary winding is wound and the region on which the common primary winding is wound is formed. These openings expose parts of the core inserted in the magnetic core insertion hole. The core in the magnetic core insertion hole and the core located outside the magnetic core insertion hole are adhesively bonded to each other through their respective openings in the cylindrical portion.

Preferred forms of the primary winding 11 are as follows. Insulating coated lead is preferably used as the primary winding 11 and wound around the outer surface of the cylindrical portion 13*a* of the bobbin 13. More preferably, the primary winding 11 is made of lead such as polyurethane resin coated lead, polyester resin coated lead, enamel resin coated lead. Furthermore, the metal wire of the primary winding 11 is not limited to unbraided wire. The primary winding 11 may be braided wire such as litz wire. The cross sectional shape of the metal wire of the primary winding 11 is not limited to a circle. The primary winding 11 may be flat wire of rectangular cross section or square wire of square cross section. In addition, the primary winding 11 may be self fusion bonded wire consisting of the insulating coated lead that is coated with a resin of low melting point.

The ends 11*a* of the primary winding 11 are preferably bound to the connecting portions 14*c* of the different connected terminals 14 mounted on at least one of the bases 13*b* mounted on at least the opposite ends of the cylindrical portion of the bobbin 13 while the insulating coating is peeled off. The ends 11*a* are electrically connected with the connected terminals 14 by soldering.

Preferred forms of the secondary winding 12 are as follows. Preferably, the secondary winding 12 is wound on plural separate regions partitioned from each other on the outer surface of the cylindrical portion 13*a* of the bobbin 13. In the same way as the primary winding 11, insulating coated lead is preferably used as the secondary winding 12. More preferably, the secondary winding 12 is made of lead such as polyurethane resin coated lead, polyester resin coated lead, enamel resin coated lead, or the like. Furthermore, the metal wire of the secondary winding 12 is not limited to unbraided wire. The secondary winding 12 may be braided wire. The cross sectional shape of the metal wire of the secondary winding 12 is not limited to a circle. The secondary winding 12 may be flat wire of rectangular cross section or square wire of square cross section. In addition, the secondary winding 12 may be self fusion bonded wire consisting of the insulating coated lead that is coated with a resin of low melting point. The secondary winding 12 needs to have a large number of turns to produce a high voltage. Therefore, it is generally preferred that the secondary winding 12 is smaller in wire diameter than the primary winding 11.

The ends 12*a* of the secondary winding 12 are preferably bound to the connecting portions 14*c* of the different connected terminals 14 mounted on the other base 13*b* mounted on at least the opposite ends of the cylindrical portion 13*a* of the bobbin 13 while the insulating coating is peeled off, in the same way as the ends 11*a* of the primary winding 11. The ends 12*a* are electrically connected with the connected terminals 14 by soldering.

Preferred forms of the bobbin 13 are as follows. The bobbin 13 is preferably made of an insulative resin. More preferably, the bobbin is made of a heatproof, insulative resin such as phenolic resin, polyester resin, or liquid crystal polymer resin from which the plural connected terminals 14 can be injection-molded.

Preferably, the bobbin 13 has at least the cylindrical portion 13*a* and the bases 13*b* mounted on the opposite ends of the cylindrical portion 13*a*. The invention is not limited to this structure. The bobbin may have a so-called twin structure having plural secondary windings for lighting up plural electric-discharge lamps. An additional base may be mounted in an intermediate region on the surface of the cylindrical portion 13*a*, and the connected terminals may be mounted on this base.

On the cylindrical portion 13*a* of the bobbin 13, the region on which the primary winding 11 and the region on which the secondary winding 12 are wound are preferably partitioned from each other by the middle guard 13*d*. The region on which the secondary winding 12 is wound is preferably partitioned into plural subregions by the middle guard 13*d*. The middle guard 13*d* for partitioning the region on which the secondary winding 12 is wound into the subregions is preferably provided with a transitional groove permitting the secondary winding 12 to be wound on the adjacent subregions in turn.

Preferably, the connected terminals 14 to which the ends 11*a* of the primary winding 11 or the ends 12*a* of the secondary winding 12 are bound are mounted on the bases 13*b* of the bobbin 13. The connected terminals 14 mounted on the bases 13*b* are preferably of the so-called gull wing type in a case where the connected terminals are surface-mounted by reflow soldering on a substrate on which an inverter circuit is fabricated. Where the connected terminals are inserted in through-holes formed in a circuit board and bonded by flow soldering, the connected terminals are preferably of the pin type. The pin type connected terminals extend through the bases 13*b* perpendicularly.

The magnetic core insertion hole 13*c* in the bobbin 13 is preferably formed so as to extend through the center of the cylindrical portion 13*a*. The inside dimension of the magnetic core insertion hole 13*c* in the cylindrical portion 13*a* in the region on which the secondary winding 12 is wound is preferably set slightly larger than the outside dimension of the I-shaped core 15*a* to permit insertion of the I-shaped core 15*a*.

One preferred form of the connected terminals 14 is as follows. Each of the connected terminals 14 preferably has a buried portion buried in the base 13*b*, terminal portion 14*a* protruding from the base 13*b*, and connector portion 14*c*.

Preferable forms of the aforementioned core subassembly 15 are as follows. The cores 15*a* and 15*b* can be made of Mn—Zn based ferrite, Ni—Zn based ferrite, powder magnetic core, laminate metal sheets, and other various magnetic materials. Preferably, at least one of the cores 15*a* and 15*b* is inserted into the magnetic core insertion hole 13*c* in the bobbin 13. When the cores are combined, a magnetic path is preferably formed. The contour of the core subassembly 15 is preferably U-U type, U-I type, or the like such that the cores are accommodated along the frame of a liquid crystal display panel. The present invention is not limited to this contour. Where a thin transformer for a power supply should be obtained, E-E-type, E-I-type, or Square-I-type may be used.

Preferable forms of the method of adhesively bonding the cores are as follows. The core 15*a* located in the magnetic core insertion hole 13*c* and the core 15*b* located outside the hole 13*c* are preferably bonded together with the adhesive 16 through the opening 13*f* formed in the cylindrical portion 13*a*. They may be bonded together only with the adhesive 16. To stably hold the core 15*a* in the magnetic core insertion hole 13*c* and the core 15*b* located outside the hole 13*c* with a given space therebetween, the spacer 17 is inserted, for example. Preferably, the core 15*a* located in the magnetic core insertion hole 13*c* and the core 15*b* located outside the hole 13*c* are bonded together with the adhesive 16 through the spacer 17.

Preferably, the adhesive 16 used to bond together the cores is made chiefly of an insulative resin. If necessary, an inorganic filler may be contained. The used adhesive can be selected from epoxy resin based adhesives and silicone resin based adhesives which have high heatproofness. Epoxy resin based adhesives are more preferably used such that vibrations of the core 15*a* located in the magnetic core insertion hole 13*c* and vibrations of the core 15*b* located outside the magnetic core insertion hole 13*c* limit each other.

A preferable form of the spacer 17 is as follows. The spacer 17 is made of a nonmagnetic insulator to prevent the magnetic path from being short-circuited when the spacer is inserted between the core 15*a* located inside the magnetic core insertion hole 13*c* and the core 15*b* located outside the hole 13*c*; otherwise, magnetic coupling between the primary winding 11 and secondary winding 12 would deteriorate. For example, the material of the bobbin 13 is preferably selected from the insulative resins presented as described above. From the viewpoint of rigidity, liquid crystal polymer resins are more preferably used.

No restrictions are imposed on the shape of the spacer 17 as long as it can be inserted between the core 15*a* located inside the magnetic core insertion hole 13*c* and the core 15*b* located outside the hole 13*c*. The shape of the spacer can be selected appropriately from various shapes. Preferably, the spacer 17 is shaped like a rod or flat plate to permit the regions of the bobbin 13 on which the primary winding 11 and secondary winding 12 are respectively wound to be brought closer to each other.

To facilitate mounting to the cylindrical portion 13*a* of the bobbin 13, a notch is more preferably formed in the outer surface of the cylindrical portion 13*a* of the bobbin 13 such that the spacer is fitted in the outer surface of the cylindrical portion 13*a*.

Preferably, the spacer 17 is higher than the adhesive 16 in hardness. This reduces variations in sound pressure due to buzzing noises.

A transformer according to a second embodiment of the present invention is next described by referring to FIGS. 5-8, the transformer being for use in a power supply. FIG. 5 is a perspective view showing the appearance, or whole structure, of the transformer for power supply 20 of the present embodiment. FIG. 6 is a vertical cross section taken on line B-B of FIG. 5, showing the internal structure of the transformer for power supply 20 of the present embodiment. FIG. 7 is a vertical cross section taken on line C-C of FIG. 5, showing the internal structure of the transformer 20 of the present embodiment. FIG. 8 is an exploded perspective view showing the internal structure of the transformer for power supply 20 of the present embodiment.

As shown in FIGS. 5-8, the transformer for power supply 20 of the present embodiment has a primary winding 21, a secondary winding 22, a bobbin 23 on which the primary winding 21 and the secondary winding 22 are separately wound, and a core subassembly 25 mounted in the bobbin 23 to form a closed magnetic loop, magnetically coupling the primary winding 21 and secondary winding 22, in the same way as the transformer for power supply 10 of the previous embodiment.

In particular, the bobbin 23 has a cylindrical portion 23*a* and plural bases 23*b* mounted at least on the opposite ends of the cylindrical portion 23*a*. The cylindrical portion 23*a* is provided with a magnetic core insertion hole 23*c* and has a wire winding area. The wire winding area is partitioned into plural regions by middle guard 23*d*. Plural connected terminals 24 are mounted on the bases 23*b*, respectively.

The primary winding 21 is wound on some region of the cylindrical portion 23*a*. Ends 21*a* of the primary winding 21 are connected with different connected terminals 24 of at least one of the bases 23*b* of the bobbin 23.

The secondary winding 22 is wound on the other region of the cylindrical portion 23*a*. Ends 22*a* of the secondary winding 22 are connected with different connected terminals 24 of the other base 23*b* of the bobbin 23.

At least one core of the core subassembly 25 is inserted in the magnetic core insertion hole 23*c*. At least some parts of the core subassembly 25 are bonded to the bases 23*b* with adhesive 26.

The cylindrical portion 23*a* of the bobbin 23 is provided with an opening 23*f* on the upper side of the space between the regions on which the primary winding 21 and secondary winding 22 are respectively wound to expose a part of a center pole of magnetic core 25*a* of the core subassembly 25 inserted in the magnetic core insertion hole 23*c*.

A spacer 27, for example, in the form of a flat plate is inserted between the center pole of magnetic core 25*a* of the core subassembly 25 located inside the magnetic core insertion hole 23*c* and a side pole of magnetic core 25*b* of the core subassembly 25 located outside the hole 23*c*. The center pole of magnetic core 25*a* located inside the magnetic core insertion hole 23*c* of the E-shaped core 25 and the side pole of magnetic core 25*b* located outside the hole 23*c* are bonded to each other via the spacer 27 with the adhesive 26 through the opening 23*f* in the cylindrical portion 23*a*.

A first difference of the transformer for power supply 20 of the present embodiment with the transformer for power supply 10 of the previous embodiment is that the shape of the core subassembly 25 has been modified. In particular, the core subassembly 25 consists of a pair of E-shaped cores. Each E-shaped core includes the center pole of magnetic core 25*a*, side pole of magnetic cores 25*b* disposed on the opposite sides of the center pole of magnetic core 25*a*, and a yoke portion 25*c* connecting respective one sides of the center pole of magnetic core 25*a* and side pole of magnetic cores 25*b*. The front sides of the center pole of magnetic cores 25*a* of the E-shaped cores 25 of one pair are inserted in the magnetic core insertion hole 23*c* extending through the cylindrical portion 23*a* of the bobbin 23. These front sides are abutted against each other around the longitudinal center of the inside of the magnetic core insertion hole 23*c*. Outside the magnetic core insertion hole 23*c*, the side pole of magnetic cores 25*b* of the E-shaped cores 25 of one pair are abutted against each other around the longitudinal center of the magnetic core insertion hole 23*c* of the bobbin in the same way as the foregoing.

A second difference of the transformer 20 of the present embodiment with the transformer 10 of the previous embodiment is that the shape of the spacer 27 has been modified according to the modification of the shape of the core subassembly 25. In particular, the spacer 27 is shaped like the letter U and assumes the form of a flat plate. The spacer 27 is provided with a notch 27*c* into which the cylindrical portion 23*a* fits such that the front ends are inserted between the center pole of magnetic core 25*a* of the E-shaped core 25 located inside the magnetic core insertion hole 23*c* in the bobbin 23 and the side pole of magnetic cores 25*b* of the E-shaped core 25 located outside the hole 23*c*. The side pole of magnetic cores 25*b* of the E-shaped core 25 are located on the opposite sides of the center pole of magnetic core 25*a*.

The other structures, operations, and advantages of the second embodiment are similar to those of the first embodiment and their description is omitted.

In the present embodiment, the transformer for a power supply assumes a normal form. That is, one primary winding 21 and one secondary winding 22 are wound on the E-shaped cores 25 of one pair, respectively. The present invention is not limited to this structure. For example, the transformer for a power supply may be a so-called twin structure in which two primary windings and two secondary windings are wound on one core subassembly forming a closed magnetic loop.

More specifically, a bobbin similar to the foregoing bobbin may be mounted on each of two side pole of magnetic cores of the E-shaped cores of one pair, and primary and secondary windings may be wound on each bobbin in the same way as the foregoing. An opening is formed on the upper side of the cylindrical portion of each bobbin between the region on which the primary winding is wound and the region on which the secondary winding is wound to expose a part of one of side pole of magnetic cores 25*b* of one pair of the core subassembly 25 inserted in the magnetic core insertion hole.

A spacer in the form of a flat plate similar to the foregoing spacer may be inserted between each side pole of magnetic core 25*b* of the core subassembly 25 located inside the magnetic core insertion hole and the center pole of magnetic core 25*a* of the core subassembly 25 located outside the hole. The side pole of magnetic core 25*b* of the E-shaped core 25 located inside the magnetic core insertion hole and the center pole of magnetic core 25*a* located outside the hole may be bonded to each other via the spacer with adhesive through the opening in the cylindrical portion.

Examples of a transformer for use in a power supply according to the present invention are described next together with its comparative examples.

In the present disclosure where conditions and/or structures are not specified, the skilled artisan in the art can readily provide such conditions and/or structures, in view of the present disclosure, as a matter of routine experimentation. Also, in the present disclosure, the numerical numbers applied in specific embodiments can be modified by a range of at least ±50% in other embodiments, and the ranges applied in embodiments may include or exclude the endpoints.

EXAMPLE 1

The transformer 10 of the first embodiment of the present invention has the structure as already described in the first embodiment.

As shown in FIGS. 1-3, the transformer 10 of the present embodiment has the primary winding 11, the secondary winding 12, the bobbin 13 having separate portions on which the primary winding 11 and secondary winding 12 are respectively wound, and a core subassembly 15 mounted in the bobbin 13. The bobbin 13 is made of a liquid crystal polymer. The core subassembly 15 is made of an Mn—Zn based ferrite for magnetically coupling the primary winding 11 and secondary winding 12.

In particular, the bobbin 13 has the cylindrical portion 13*a* and a pair of bases 13*b* mounted on the opposite ends of the cylindrical portion 13*a*. The cylindrical portion 13*a* is provided with the magnetic core insertion hole 13*c*, and has a wire winding area. The wire winding area is partitioned into plural regions by the middle guard 13*d*. Plural terminals 14 are mounted on each of the bases 13*b*.

The primary winding 11 is wound on some region of the cylindrical portion 13*a*. The ends 11*a* of the winding 11 are connected with the connected terminals 14 of one base 13*b* of the bobbin 13.

The secondary winding 12 is wound on the other region of the cylindrical portion 13*a*. The ends 12*a* of the winding 12 are connected with the connected terminals 14 of the other base 13*b* of the bobbin 13.

At least one core of the core subassembly 15 is inserted in the magnetic core insertion hole 13*c*. The longitudinal ends of the magnetic core insertion hole 13*c* in the bobbin are bonded to the bases 13*b* with epoxy resin based adhesive.

The cylindrical portion 13*a* of the bobbin 13 is provided with the opening 13*f* on the upper side between the regions on which the primary winding 11 and secondary winding 12 are respectively wound to expose a part of the core 15*a* inserted in the magnetic core insertion hole 13*c*.

The spacer 17 is inserted between the core 15*a* located inside the magnetic core insertion hole 13*c* and the core 15*b* located outside the hole 13*c*. The spacer is shaped like a long rod and made of a liquid crystal polymer. The spacer has a thickness of 2 mm, a length of 35 mm, and a height of 1.5 mm. The I-shaped core 15*a* located inside the magnetic core insertion hole 13*c* and the U-shaped core 15*b* located outside the hole 13*c* are bonded to each other using the epoxy resin based adhesive 16 via the spacer 17 through the opening 13*f* in the cylindrical portion 13*a*.

EXAMPLE 2

The transformer of the second embodiment of the present invention for use in a power supply is similar to Example 1 described above except that the I-shaped core 15*a* inside the magnetic core insertion hole 13*c* and the U-shaped core 15*b* located outside the hole 13*c* are bonded to each other only with an epoxy resin based adhesive similar to the foregoing adhesive without using the spacer 17 of Example 1.

COMPARATIVE EXAMPLE 1

A transformer of Comparative Example 1 for use in a power supply is similar to the above-described Example 1 except that no opening is formed in the cylindrical portion of the bobbin and that varnish is impregnated and cured in the gap between the bobbin on which the primary and secondary windings are wound and the U-shaped core located outside the magnetic core insertion hole without adhesively bonding the core located inside the magnetic core insertion hole and the core located outside the hole.

COMPARATIVE EXAMPLE 2

A transformer of Comparative Example 2 for use in a power supply is similar to the above-described Example 1 except that the bobbin on which the primary and secondary windings are wound and the U-shaped core located outside the magnetic core insertion hole are bonded to each other with an epoxy resin based adhesive similar to the foregoing epoxy resin based adhesive around the longitudinal center of the magnetic core insertion hole without forming any opening in the cylindrical portion of the bobbin and without adhesively bonding together the core located inside the magnetic core insertion hole and the core located outside the hole.

REFERENCE EXAMPLE

A transformer for power supply of Reference Example is similar to the above-described Example 1 except that a rod-like spacer is inserted between the bobbin on which the primary and secondary windings are wound and the U-shaped core located outside the magnetic core insertion hole around the longitudinal center of the magnetic core insertion hole without forming any opening in the cylindrical portion of the bobbin and that the bobbin and the U-shaped core located outside the magnetic core insertion hole are bonded together with an epoxy resin based adhesive similar to the foregoing epoxy resin based adhesive without adhesively bonding together the core located inside the magnetic core insertion hole and the core located outside the hole.

Each of transformers for power supply of the above-described Examples, Comparative Example, and Reference Example for use in power supplies, each type of transformers for power supply being 75 in number, was inserted as a transformer T1 in an inverter circuit of an electric-discharge lamp lighting device shown in FIG. 9.

In FIG. 9, the range surrounded by the dot-and-dash line indicates the electric-discharge lamp lighting device, which includes four field-effect transistors (FETs) Q1-Q4, a capacitor C1, an inverter transformer T1, a resistor R1 for detection of an electrical current, a drive control circuit, a current detection circuit, an oscillation circuit, a lighting-frequency shift circuit is lit on, and electric-discharge lamps (Lamp-1 to Lamp-n (where n is a natural number)). The electric-discharge lamp lighting device has a full-bridge inverter circuit. In the present embodiment, external electrode fluorescent lamps are used as the electric-discharge lamps (Lamp-1 to Lamp-n) as an example. The input voltage is 24 V. The output voltage is so set that a voltage of 1 kV rms is applied across each lamp. The operation frequency is 50 kHz. The total load current is about 100 mA for all the lamps.

After activating each transformer under given conditions, the duty cycle was varied to 20 to 100% under conditions including ADIM=0 V and a burst frequency of 270 Hz. The sound pressure level of buzzing noise produced from each of the transformers for a power supply was measured within a sound shield room by a sound level meter located at a distance of 10 cm above the transformer for power supply. For each type of transformer, the average value from the 75 transformers is shown in FIG. 10.

As is obvious from FIG. 10, where transformer for power supply of Example 1 or Example 2 of the present invention were used, the sound pressure levels of buzzing noises were about 32 dB. In contrast, the sound levels from transformer for power supply of Comparative Example 2 or Reference Example exceeded 36 dB. The sound level from the varnish-impregnated transformer for power supply of Comparative Example 1 was in excess of 38 dB.

Each of the transformers for power supply of the above-described Examples, Comparative Examples, and Reference Example for use in power supplies, each type of transformers for power supply being 75 in number, was inserted as the transformer T1 in the inverter circuit of the electric-discharge lamp lighting device shown in FIG. 9. After activating the lighting device under given conditions, the duty cycle was held to 20% under conditions including ADIM=0 V and a burst frequency of 270 Hz. The sound pressure level of buzzing noise produced from each transformer for a power supply was measured in the same way as in the above-described measurements. The results of measurements of the buzzing noise levels, i.e., degrees of variations, from the 75 transformer for power supply are shown in FIG. 11.

As is obvious from FIG. 11, where the transformer for power supply of Example 1 or Example 2 of the present invention were used, the sound pressure levels of buzzing noises were about 32 dB. It can be seen that variations in sound pressure level among the individual products of the transformer for power supply 10 of Example 1 in which the cores bonded via the spacer 17 using adhesive are smaller than variations in sound pressure level among the individual products of the transformer for power supply of Example 2 in which the cores are bonded together only with adhesive.

Similarly, the sound pressure levels from the transformer for power supply of Comparative Example 2 and Reference Example were higher than 36 dB. It can be seen that the variations in sound pressure levels among the individual products of the transformer for power supply of Reference Example in which the cores are bonded together adhesively via the spacer are slightly lower than the variations in sound pressure level among the individual products of the transformer for power supply of Comparative Example 2 in which the cores are bonded together only with adhesive.

The sound pressure level of the buzzing noise from the varnish-impregnated transformer for power supply of Comparative Example 1 was in excess of 38 dB. The result is that variations at higher levels of pressure sound are relatively small.

Transformer for power supply according to the present invention are adapted for use in various electronic instruments including backlights such as liquid crystal TVs.

The present application claims priority to Japanese Patent Application No. 2007-278225, filed Oct. 25, 2007, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A transformer for use in a power supply, comprising:

a primary winding;

a secondary winding;

a bobbin on which the primary winding and the secondary winding are separately wound, said bobbin being provided with a magnetic core insertion hole, said bobbin having a trunk portion through which the magnetic core insertion hole is formed, and plural bases connected at least to both ends of the trunk portion, said trunk portion having a wire winding area partitioned into plural regions by middle guards, each of said bases having plural terminals connected thereto; and a core subassembly including cores and connected to the bobbin, the core subassembly forming a closed magnetic loop to magnetically couple the primary and secondary windings;

wherein the primary winding is wound on one of the regions of the trunk portion and has ends connected with different terminals of the bases;

wherein the secondary winding is wound on another of the regions of the trunk portion and has ends connected with different terminals of the bases other than the terminals with which the ends of the primary winding are connected;

wherein an inside core of the core subassembly is inserted in and located inside the magnetic core insertion hole, whereas an outside core of the subassembly is located outside the magnetic core insertion hole, at least some parts of the core subassembly being adhesively bonded to the bases;

wherein the trunk portion of the bobbin is provided with an opening between the regions on which the windings are wound to expose a part of the core inserted in the magnetic core insertion hole;

wherein the core located inside the magnetic core insertion hole and the core located outside the magnetic core insertion hole are adhesively bonded together through the opening in the trunk portion; and wherein a spacer is inserted between the core located inside the magnetic core insertion hole and the core located outside the magnetic core insertion hole at a location of the opening, and wherein the core located inside the magnetic core insertion hole and the core located outside the magnetic core insertion hole are adhesively bonded together through the opening via the spacer.

2. The transformer for use in a power supply as set forth in claim 1, wherein the core subassembly is comprised of two pieces, wherein one piece is the inside core, and another piece is the outside core.

3. The transformer for use in a power supply as set forth in claim 2, wherein the inside core of the core subassembly is an I-shaped core and the outside core of the core subassembly is a U-shaped core.

4. The transformer for use in a power supply as set forth in claim 1, wherein the core subassembly is comprised of two pieces, wherein one piece constitutes a part of the inside core and a part of the outside core, and another piece constitutes the remaining part of the inside core and the remaining part of the outside core.

5. The transformer for use in a power supply as set forth in claim 4, wherein each piece is an E-shaped core.

6. The transformer for use in a power supply as set forth in claim 1, wherein the spacer is made of a nonmagnetic material.

7. The transformer for use in a power supply as set forth in claim 1, wherein the spacer is placed in position next to the middle guards of the trunk portion.

8. The transformer for use in a power supply as set forth in claim 1, wherein the spacer is provided with a notch into which the trunk portion fits.

9. The transformer for use in a power supply as set forth in claim 1, wherein the spacer has higher hardness than the adhesive.

* * * * *